United States Patent [19]

Rowell

[11] 4,054,015

[45] Oct. 18, 1977

[54] CHIP PACKING APPARATUS AND METHOD

[75] Inventor: Lorne A. Rowell, Victoria, Canada

[73] Assignee: Imasco, Ltd., San Mateo, Calif.

[21] Appl. No.: 687,008

[22] Filed: May 17, 1976

[51] Int. Cl.[2] ..... B65B 35/50; B65B 57/10

[52] U.S. Cl. ..... 53/26; 53/61; 53/159; 214/6 D

[58] Field of Search ..... 53/26, 61, 62, 78, 159; 100/422; 214/6 D

[56] References Cited

U.S. PATENT DOCUMENTS

| | | | |
|---|---|---|---|
| 2,845,759 | 8/1958 | Cote et al. | 53/61 |
| 3,670,474 | 6/1972 | Vieson et al. | 53/62 X |
| 3,774,782 | 11/1973 | Lewis | 214/6 D |

*Primary Examiner*—Travis S. McGehee

*Attorney, Agent, or Firm*—Flehr, Hohbach, Test, Albritton & Herbert

[57] ABSTRACT

An apparatus for stacking food chips in a cylindrical container. Random chips are oriented into tandem alignment on an inclined conveyor traveling in an upward direction and are deposited into an upright cylindrical stacking tube above a station for the empty cylindrical containers. A valve comprising operatively associated upper and lower blades in the stacking tube load vertical stacks of chips into the cylindrical containers.

13 Claims, 3 Drawing Figures

CHIP PACKING APPARATUS AND METHOD

BACKGROUND OF THE INVENTION

The present invention relates to the packing of food chips as a stack in a cylindrical container.

Various techniques have been employed for stacking food chips or other disc-shaped food articles. In one system, disclosed in U.S. Pat. No. 3,084,783, flat cookies are moved downwardly over a rotating drum provided with a plurality of steps or ledges and are thereafter received on a projecting surface upon which the cookies are retained in a vertical orientation or on edge for subsequent packing. However, there is no disclosure of the packing technique or apparatus. Additional equipment is required to fill the stack of chips into a container.

U.S. Pat. No. 3,207,288 discloses a conveyor for stacking cookies which may be vibrated. At the end of the conveyor the chips are vertical or on edge. No packaging technique is set forth for the stacked cookies.

In U.S. Pat. No. 3,609,939, chips are directed through a horizontal metering trough in which a predetermined number of chips are measured by a periodic cut-off metering stop. A sweep arm engages chips of the stack and pushes them into a horizontally disposed container.

In U.S. Pat. No. 3,677,391, picker members engage chips under vacuum and space them on a conveyor. This individual handling of chips is a time consuming and expensive operation. Then, the chips are reoriented to a vertical position by differences in elevations of adjacent conveyors. After stacking as above, the chips are packed into a horizontal container.

U.S. Pat No. 3,786,617 relates to an apparatus for the stacking of disc-shaped articles such as biscuits. The discs are vertically stacked in a stacking tube by an unknown technique. Thereafter, stacks of discs are slid horizontally into the open side of a vertical container.

SUMMARY OF THE INVENTION AND OBJECTS

In the present invention, an apparatus and method are provided for stacking food chips through the top of a cylindrical container. Random food chips are reoriented into tandem alignment on a conveyor for continuously feeding a stacking tube. The conveyor slopes upwardly toward the stacking tube. The chips travel in recesses on the conveying surface and overflow the conveyor at spaced intervals to gravitate into the stacking tube. A valve formed of upper and lower blades spaced a distance corresponding to the predetermined chip stack size is operatively associated with the stacking tube. An empty cylindrical container is directed to a chip receiving station below the stacking tube. During loading of the stacking tube, the valve upper blade is retracted and the valve lower blade blocks chips. For filling the container, the blade positions are reversed. The chips in the stacking tube are vibrated to decrease their stability on edge.

It is an object of the present invention to provide an efficient and economical method and apparatus for stacking disc-shaped food chips in a cylindrical container using gravity feed.

Further objects and features of the invention will be apparent from the following description taken in conjunction with the accompanying drawing.

DETAILED DESCRIPTION OF THE PREFERRED EMBODIMENTS

Figure 1:
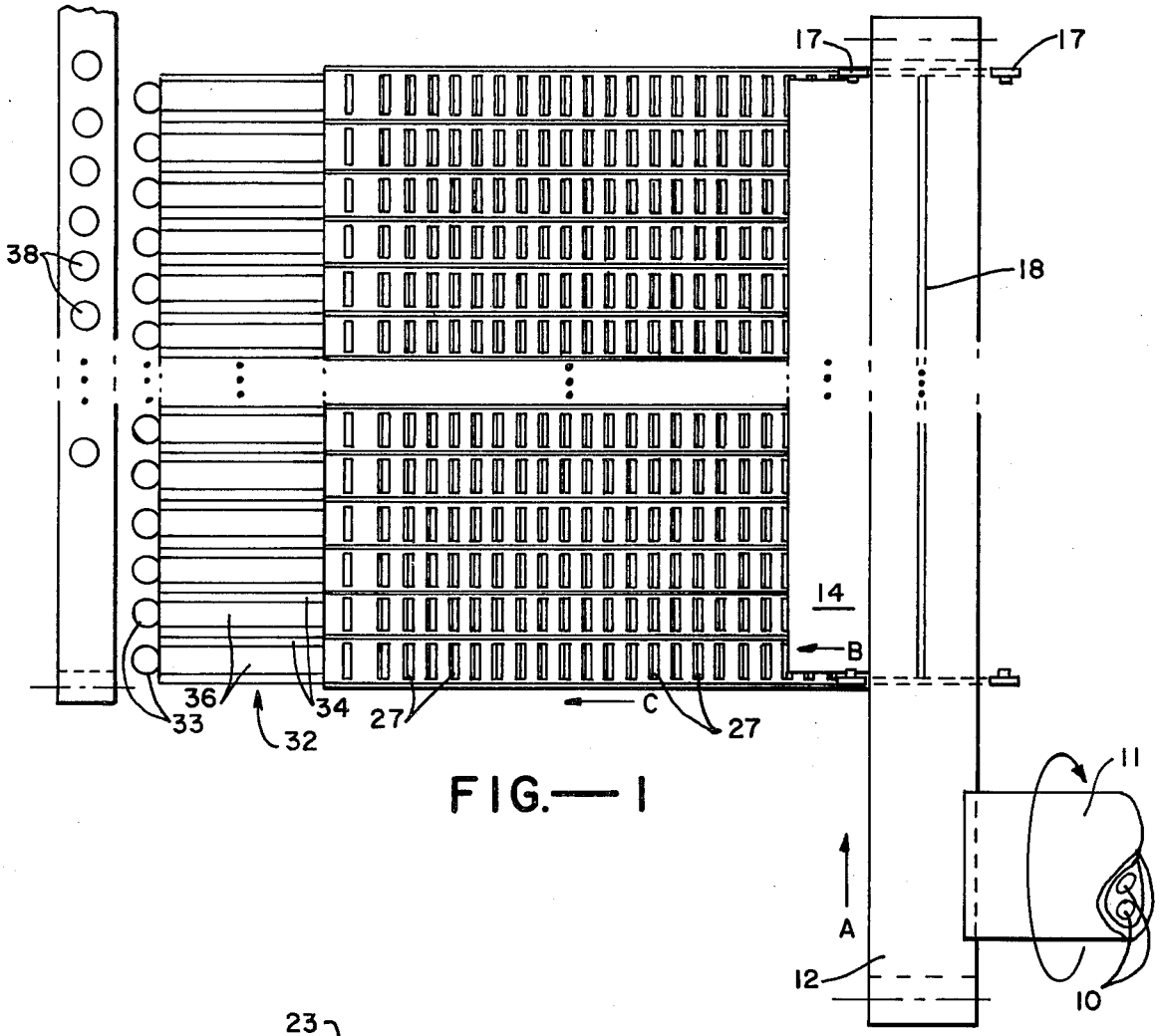
FIG. 1 is a schematic representation of a top view of a multiple lane chip orienting and packing apparatus in accordance with the present invention.

In accordance with the present invention, chips are oriented and packed into cylindrical containers. The chips are formed in disc shape with relatively small variance in diameter from chip to chip. The present apparatus has been employed successfully with tortilla chips with a diameter of approximately 7 cm. and a thickness of about 3 mm.

The chips 10 are tumbled in a rotating flavoring cylinder 11 with salt and/or other flavoring ingredients in a continuous stream. The chips are then deposited onto conveyor 12 with a direction of travel designated by arrow A. A sweeper mechanism 13 is provided to direct chips from conveyor 12 to conveyor 14 traveling perpendicular to the same in the direction of arrow B. Mechanism 13 comprises a conveyor belt 16 mounted on pulleys 17 and including a normally projecting sweeping blade 18. Mechanism 13 sweeps the chips from conveyor 12 when the leading edge of the flow of chips from cylinder 11 reaches the far side or downstream end of conveyor 14. Careful adjustment of the speed of conveyor belt 16 accomplishes this objective. The time for one cycle of sweeper blade 18 is set to be equal to the time for the chips to travel the full width of conveyor 14. The speed of conveyor 14 is relatively slow compared to conveyor 12 so that as the chips are swept onto the same they are metered into an essentially constant flow to an inclined conveyor assembly 20.

Conveyor assembly 20 serves to receive the randomly oriented food chips from conveyor 14 and to translate them into a plurality of lanes of continuous tandem alignment at a depth of no greater than two chips. Assembly 20 includes a plurality of inclined upper conveying surfaces **21*a* of belts 21 supported at the lower or in feed end by pulley 22 and at the upper or outlet end by pulley 23. The direction of travel of conveying surfaces 21*a* is indicated by arrow C. Side walls 24 are mounted to the sides of each conveying surface 21*a* parallel to the line of travel. Walls 24** are spaced apart a distance selected to define channels or lanes therebetween on the conveying surfaces a distance slightly larger than the chip diameter.

In the illustrated embodiment, recesses are formed on conveying surfaces **21*a* to carry a maximum of two chips on the conveying surfaces 21*a*. Such recesses are defined by projecting spaced apart partitions or bars 27 perpendicular to the line of travel. The projection of bars 27 normal to the conveying surfaces 21*a* is adjusted so that the depth of recesses 28** accomodate a maximum of two chips.

It is important to proper stacking of the chips in the containers that a maximum of two chips at a time reaches the stacking tube. Since the recesses are a maximum of two chips in depth, this will be accomplished so long as there are no excess chips carried by the conveyor above bars 27. It is desirable to facilitate the downward slide of excess chips on surfaces 21*a* toward the infeed side of the conveyor to prevent them from being fed to the stacking tube. This is accomplished by providing a sufficient inclination to the conveying surfaces such as a minimum of 40° to 50° to the horizontal Vibrating means 29 may be provided for vibrating conveyor belt 21 including a vibrating surface 30 mounted to an eccentric drive 31. Vibrating means 29 urges chips unsupported in recesses 28 to slide downwardly on conveying surfaces 21*a* until they rest in an empty recess or pocket 28 or are returned towards conveyor 14.

It should be understood that other mechanisms may be employed for facilitating the downward slide of chips. For example, in an embodiment not shown, a sweeper such as a brush may be provided which touches the conveying surfaces 21*a* to brush excess chips downwardly. Such a mechanism could be used together with or in place of vibrating means 29.

Chips 10 overflow the top of pulley 23 and are deposited by gravity onto chute 32 extending between the outlet end of belts 21 and the upper end of a series of stacking tubes 33 to be described hereinafter. Chute 32 includes a plurality of partition guides 34 projecting normal to the conveying surface of the chute and defining lanes 36 therebetween. Partitions 34 are parallel to the line of travel of the chips and are aligned with and adjacent to corresponding side walls 24 of belts 21. Guides 34 are suitably in the form of corrugations of triangular cross-section which project to a point at the free end. One stacking tube 33 is disposed at the lower end of such lane 36.

The number of lanes and corresponding stacking tubes is dependent upon the desired production of filled containers for an individual unit. It is apparent that a single conveyor line feeding a flavoring cylinder 11 may supply an orienting and stacking unit for filling as many as 10 or more containers simultaneously. The remainder of the description will relate to a single channel and corresponding stacking tube 33. However, it should be understood that it applies as well to the identical arrangements for the remaining stacking tubes.

Figure 2:
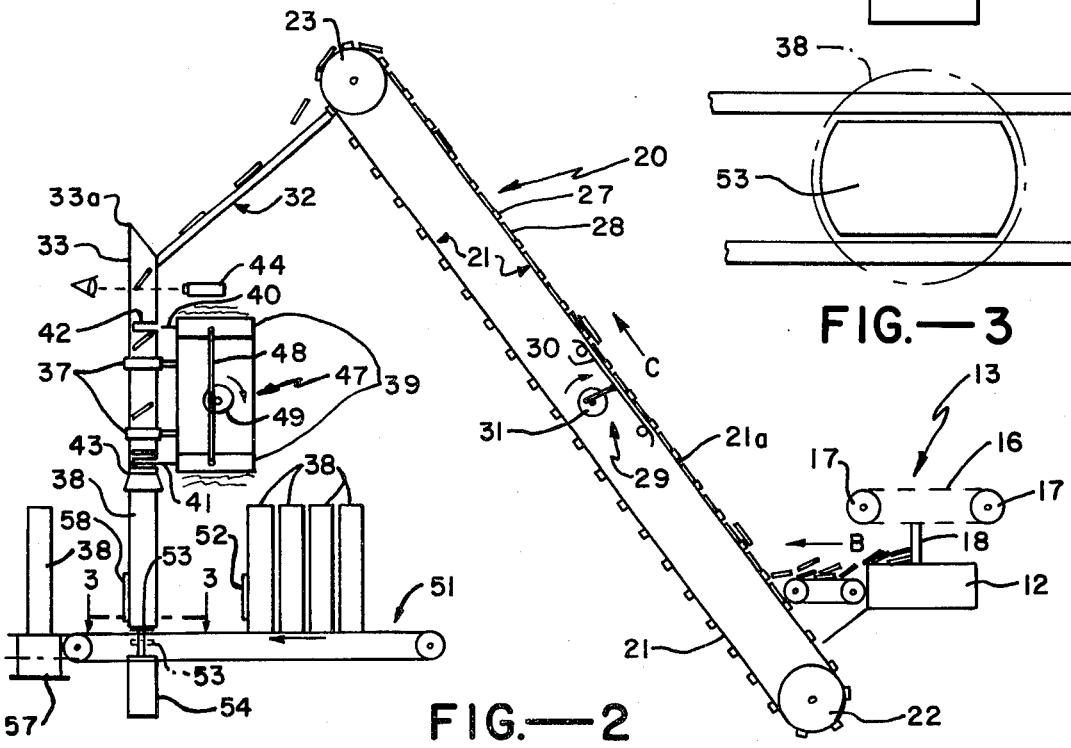
FIG. 2 is a schematic representation of a side elevational view of the apparatus of FIG. 1.

Referring to FIG. 2, stacking tube 33 is a cylindrical tube mounted in an upright, preferably vertical, position suitably attached to and supported by brackets 37. The inner diameter of the cylinder is slightly larger than the predetermined diameter of the chips. The upper end of the stacking tube is defined by a sloping plane with the upper edge 33*a* aligned with and furthest removed from the entry of chips from chute 32. This arrangement serves as a back stop to prevent chips from flying off the chute. The lower end of tube 33 flairs outwardly for ready registry with empty containers 38 to be filled as described below.

Valve means 39 is associated with stacking tube 33 for automatically loading a stack of predetermined size of the food chips into an individual container 38. Valve means 39 comprises vertically spaced upper and lower horizontally disposed retractable blades 40 and 41 which are aligned with corresponding horizontal slits 42 and 43 in tube 33. The distance between blades 40 and 41 correspond to the predetermined chip stack size for loading into container 38. Valve means 39 includes a stacking tube loading position and a container filling position. In the former position, upper blade 40 is retracted and lower blade 41 extends across tube 33 to block falling chips. In the latter position, upper blade 40 is actuated into a chip blocking position across tube 33 while lower blade 41 is retracted from the tube to permit gravity feed to the container of a stack of a size determined by the difference in elevation of the blades.

At the beginning of operation, valve means 39 is in the loading position for the stacking tube so that blade 41 is in the blocking position while blade 40 is in a retracted position. During this time, chips moving on conveyor 32 gravitate downwardly to strike and rest upon blade 41 which serves as a surface for supporting a stack of chips. Because of the tandem arrangement of the chips as they are conveyed onto chute 32 and into tube 33, no more than two chips at a time strike blade 41. Such chips are relatively unstable to standing on edge and so fall to a horizontal position and form a vertical stack of horizontal chips. When this stack reaches the elevation of detector 44, blade 40 moves into a chip blocking position and, simultaneously, blade 41 is retracted so that a stack of chips of a size determined by the distance between the blades is permitted to gravitate into container 38.

The foregoing procedure is controlled by a level detector 44, suitably in the form of a photocell which distinguishes between falling chips and stacked chips, disposed slightly above upper blade 40. Detector 44 is operatively associated with blades 40 and 41 and actuates blade 41 into a retracted position and blade 40 into a blocking position only after stacked chips are sensed or viewed adjacent the detector. This occurs when the space between the blades is filled with a stack of chips.

Chute 32 serves the function of guiding the chips directly in line with tube 33 and accelerating them to further the separation of the chips with the stacking.

Vibrating means is associated with the stacking tube to further decrease the stability of the chips to stand on edge. In the illustrated embodiment, such vibrating means includes a vibration assembly 47 connected to blades 40 and 41 and to mounting brackets 37 of tube 33. Assembly 47 suitably includes connecting rod 48 linking both blades and eccentrically mounted to a rotating wheel 49. Assembly 47 imparts on oscillating movement to blades 40 and 41 and to tube 33. By vibrating the blades, the chips are directly vibrated at the stacking surfaces of blades 40 and 41. In an alternative embodiment, vibrating means for the blades 40 and 41 or tube 33 may be eliminated.

A series of empty cylindrical containers 38 are packed with chips from stacking tube 33. Such containers are cylindrical in shape and may be formed of a plastic or cardboard cylinder wall with a metal or plastic bottom wall rigidly attached to the same. The upper end of the cylinder is open during filling and is thereafter sealed with a top.

Feed means is provided to position the upper open end of cylinder 38 into abutting relationship with the lower flaired end of stacking tube 33. Such flairing assists precision positioning. To avoid disruption of the stack of chips in tube 33 by the upper rim of container 38 during filling of the container, the inner diameter of tube 33 is no larger than about the diameter of container 38.

Figure 3:
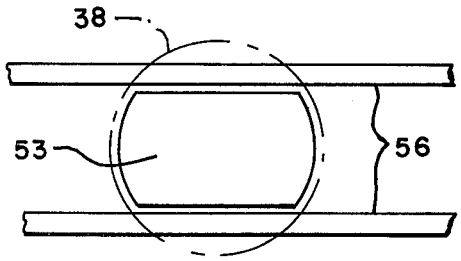
FIG. 3 is a top cross-sectional expanded view taken along the line 3—3 of FIG. 2 showing the container elevator and conveyor.

For continuous operation, suitable feed means is provided for feeding an empty container 38 to abutting relationship with the bottom of the stacking tube and removing the same tube immediately after filling for replacement by a subsequent empty container. A series of empty containers 38 are continuously supplied to a conveyor 51. As illustrated in FIG. 3, conveyor 51 comprises parallel spaced narrow belts or bands 56. A first automatic stop mechanism 52 is disposed above conveyor 51 and includes a container blocking position, illustrated in FIG. 2, and a retracted position (not shown) in which the containers are free to pass. Mechanism 52 is operable to normally block the row of empty containers 38 and is actuated to a retracted position in response to completion of the filling cycle of a downstream container.

An elevator means is provided comprising a table 53 and an automatically actuated air cylinder 54. Table 53 is located at the container receiving station directly below stacking tube 33 between belts 56 and includes a lower position below the conveying surface of conveyor 51 out of contact with the containers thereon (illustrated phantom in FIG. 2). In the upper position of table 53, it extends above the conveying surface of conveyor 51 so that the upper edge of container 38 is placed in abutting relationship with the bottom of the stacking tube for filling (illustrated in solid lines in FIG. 2). A second automatic stop mechanism 58 is disposed above table 56 and includes a container blocking position to locate one conveyor directly below filling tube 33, and a retracted position (not shown) in which the containers are carried again along conveyor 51. Conveyor 51 terminates adjacent an overlapping edge of crossing conveyor 57 which removes the filled containers for the next operation. Parallel guides, not shown, are provided to the sides of conveyor 51 downstream from the filling station to facilitate transfer of the filled containers onto belt 57.

The foregoing system may be employed for orienting and packing of food chips as follows. A row of empty containers 38 are continuously supplied on conveyor 51 and are normally blocked by stop mechanism 52. In the filling operation stop mechanism 52 is retracted and a container 38 is directed on conveyor 51 to closed stop mechanism 58 which precisely positions the container below filling tube 33. After the passage of one container, stop mechanism is reactuated to its normal blocking position. For filling, the container 38 is elevated on table 53 into abutment with the lower edge of stacking tube 33. After filling, table 53 is lowered and stop mechanism 58 is retracted so that the filled container is removed on conveyor 51 onto conveyor 57 for the next operation. Then, the operation is repeated by first advancing the next empty container past retracted stop mechanism 52 to closed stop mechanism 58.

The chips are rotated in a continuous stream in the downwardly tilting rotating flavoring drum 11 for depositing onto the conveyor 12. The chips are then carried in the direction of arrow A on conveyor 12. Blade 18 periodically sweeps the chips off conveyor 12 onto slower moving conveyor 14 as the chips reach the far edge of conveyor 14. Inclined conveying surfaces **21*a* passes upwardly adjacent to the outflow end of conveyor 14 and carries the chips overflowing the former conveyor upwardly in recesses 28 provided between bars 27. Excess chips slide downwardly on the conveying surface assisted by the vibration from vibrating means 29. In this manner, the randomly oriented chips from conveyor 14 are translated into continuous tandem alignment on the conveying surface of conveyor 20**.

At the top of conveyor 20, the chips travel on the conveying surface over pulley 23 and are deposited by gravity in tandem alignment on chute 32 upon which they slide and accelerate. Then, the accelerated aligned chips from chute 32 fall into upright stacking tube 33 onto lower blade 41 in a chip blocking position while blade 40 is in a retracted position. The chips are vibrated to decrease the stability of the chips to stand on edge. The chips form into a vertical stack with each chip being disposed in a horizontal position. When the chip stack reaches a level of detector 44 set slightly above the desired level of the stack for packing into container 38, blade 40 is actuated into a chip blocking position while blade 41 is retracted so that a column of chips between the two blades gravitates into container 38 as a unit. The fall of the column of chips from the filling tube into the empty container is cushioned by a column layer which escapes from the empty containers by passage around the relatively small clearance between the chips and inside wall of the containers 33. This prevents breakage of the chips. The chip stability to stand on edge is minimized by vibrations supplied from blades 40 and 41. After sufficient time for filling of container 38, the blade positions are reversed and the cycle of filling the stacking tube is repeated.

The foregoing description relates to a single stacking tube and container. However, as set forth above, for most efficient operation the conveyor includes a number of lanes and corresponding tube filling mechanisms which operates as set forth above. In a typical instance, each filling station includes a capacity of 200 chips per minute.

It is apparent from the foregoing that an efficient system has been provided for orienting and packing food chips from a source of randomly oriented chips in a stack in a cylindrical container. The system eliminates the problem of bridging of multiple chips standing on edge on the container which would disrupt the formation of a vertical stack by first translating the chips into tandem alignment with no greater than two chips at a time being directed into the stacking tube. Other techniques to avoid bridging include accelerating the chips on a chute and vibrating the chips in the stacking tube. The use of gravity feed simplifies the mechanism of the overall system and avoids the necessity of the use of pusher arms for the chips which are complicated to construct and can cause chip breakage.

What is claimed is:

1. In an apparatus for orienting and packing food chips in a cylindrical container comprising:

a. conveyor means having infeed and outlet ends and including chip receiving recesses on an inclined conveying surface for receiving randomly oriented food chips at the lower end of the conveying surface and translating said chips into continuous tandem alignment at the upper end of the conveying surface, b. an upright mounted cylindrical stacking tube disposed adjacent the outlet end of said conveyor means to receive and stack food chips from said conveyor, c. feed means adapted to position the upper open end of a series of empty cylindrical containers in a chip receiving station below said stacking tube in sequence so that the top edge of said container in said station is in abutting relationship with the bottom of said stacking tube, and d. valve means associated with said stacking tube for loading a stack of predetermined size of said food chips in said cylindrical container.

2. The apparatus of claim 1 together with means for vibrating food chips received by said stacking tube thereby decreasing the stability of said chips to stand on edge.

3. The apparatus of claim 1 in which said conveyor means comprises an inclined conveyor with its upper end adjacent the top of said stacking tube, said conveying surface including partitions across its line of travel spaced to define chip movement recesses, and feed means for continuously directing chips into said recesses at the lower end of said conveyor belt, whereby said chips are spaced apart in tandem alignment along the conveyor belt.

4. The apparatus of claim 3 in which said conveyor means includes an inclined chute with its upper end adjacent the outlet end of said conveyor belt and its lower end adjacent the top of said stacking tube to accelerate chips entering said tube and thereby decreasing the stability of said chips to stand on edge.

5. In an apparatus for orienting and packing food chips in cylindrical container comprising:

a. conveyor means having infeed and outlet ends and including recesses on the conveying surface for receiving randomly oriented food chips and translating said chips into continuous tandem alignment, b. an upright mounted cylindrical stacking tube disposed adjacent the outlet end of said conveyor means to receive and stack food chips from said conveyor, c. feed means adapted to position the upper open end of a series of empty cylindrical containers in a chip receiving station below said stacking tube in sequence so that the top edge of said container in said station is in abutting relationship with the bottom of said stacking tube, said valve means comprising vertically spaced upper and lower retractable blades disposed across said stacking tube, the distance between said blades corresponding to the predetermined food chip stack size, said valve means including a stacking tube loading position in which said upper blade is retracted and said lower blade is in a chip blocking position, and a container filling position in which said upper blade is in a chip blocking position and said lower blade is retracted.

6. The apparatus of claim 5 together with level detecting means for preventing retraction of said lower blade until the space between said upper and lower blades is filled with a stack of chips.

7. The apparatus of claim 5 together with means for vibrating food chips received by said stacking tube thereby decreasing the stability of said chips to stand on edge.

8. In a method for orienting and stacking rigid food chips from a source of randomly oriented chips in a cylindrical container, the steps of:

a. directing the randomly oriented chips into recesses of an inclined moving conveyor at the conveyor infeed end to translate the chips into continuous tandem alignment, b. feeding the aligned chips from the conveyor into the top of an essentially upright cylindrical stacking tube disposed below the outlet end of said conveyor and gravitating said chips onto a lower retractable chip blocking blade across said stacking tube in a manner that said chips are permitted to form a vertical stack, c. positioning the open end of an empty cylindrical container in an essentially upright position in a chip receiving station below said stacking tube, and d. retracting said lower blade to permit a chip stack of predetermined size to gravitate into said container.

9. The method of claim 8 together with the step of:

e. vibrating the chips in said stacking tube to decrease the stability of said chips to stand on edge.

10. The method of claim 8 in which no more than two chips at a time are fed from said conveyor to said stacking tube.

11. The method of claim 8 in which said conveyor is inclined with its upper end adjacent the top of said stacking tube so that said chips travel upwardly on said conveyor and excess chips slide downwardly over the recesses on the conveyor under the influence of gravity to prevent chip loading at an excessive rate in said stacking tube.

12. The method of claim 11 together with the step of:

e. accelerating the chips from the top of said conveyor to said stacking tube by sliding the chips on an inclined chute therebetween thereby decreasing the stability of said chips to stand on edge on said blades.

13. In a method for orienting and stacking food chips from a source of randomly oriented chips in a cylindrical container, the steps of:

a. directing the randomly oriented chips into recesses of a moving conveyor at the conveyor infeed end to translate the chips into continuous tandem alignment, b. feeding the aligned chips from the conveyor into the top of an essentially upright cylindrical stacking tube disposed below the outlet end of said conveyor, an associated upper retractable chip blocking blade being disposed across said stacking tube vertically spaced from a lower retractable chip blocking blade a distance corresponding to the predetermined food chip stack size, c. gravitating said chips onto said lower retractable blade in a chip blocking position with said upper blade retracted in a manner that said chips are permitted to form a vertical stack, d. positioning the open end of an empty cylindrical container in an essentially upright position in a chip receiving station below said stacking tube, and e. filling said container with said predetermined chip stack by moving said upper blade into a chip blocking position and retracting said lower blade.

* * * * *